US006116580A

United States Patent [19]

Hull

[11] Patent Number: 6,116,580

[45] Date of Patent: Sep. 12, 2000

[54] REVERSIBLE WINCH RATCHET MECHANISM

[75] Inventor: John D. Hull, Lincoln, Nebr.

[73] Assignee: Dutton-Lainson Company, Hastings, Nebr.

[21] Appl. No.: 09/352,614

[22] Filed: Jul. 13, 1999

[51] Int. Cl.[7] ..... B66D 1/14

[52] U.S. Cl. ..... 254/357; 74/577 S; 74/577 R; 254/376

[58] Field of Search ..... 254/342, 376, 254/357; 74/575, 577 R, 577 S, 577 M

[56] References Cited

U.S. PATENT DOCUMENTS

| | | | |
|---|---|---|---|
| 281,910 | 7/1883 | Moore et al. | 74/577 R |
| 2,891,824 | 6/1959 | Fulton | 254/357 |
| 2,941,627 | 6/1960 | Beebe | 254/357 |
| 3,939,729 | 2/1976 | Brockelsby | 74/577 M |
| 4,215,850 | 8/1980 | Haase et al. . | |
| 4,236,052 | 11/1980 | Haase . | |
| 4,456,227 | 6/1984 | Notenboom | 254/357 |
| 4,516,442 | 5/1985 | Davis | 74/577 S |
| 4,566,674 | 1/1986 | Ebey et al. | 254/376 |
| 4,771,987 | 9/1988 | Priest | 254/376 |

OTHER PUBLICATIONS

Fulton brochure, "Marine Trailer Winches", pp. 6–7, no date available.

Shelby Industries brochure, "Winches", pp. 4–5, no date available.

Dutton–Lainson Company brochure entitled "Ratched Winches" publishes Dec. 1997.

*Primary Examiner*—Katherine A. Matecki

*Attorney, Agent, or Firm*—Banner & Witcoff, Ltd.

[57] ABSTRACT

A mechanical winch includes a ratchet lever having a single pawl which may be positioned in either one of two orientations in order to preclude clockwise or counterclockwise movement of the winch, drum or reel. In each orientation, the ratchet lever may also be positioned in a free wheeling position for the drum.

6 Claims, 4 Drawing Sheets

26
18
76
64
68
28
30
32
48
52
20
50
16
24
70
72
66
74
56
54
22
14
12
44
46
10
36
34
40
42
38

FIG.2C
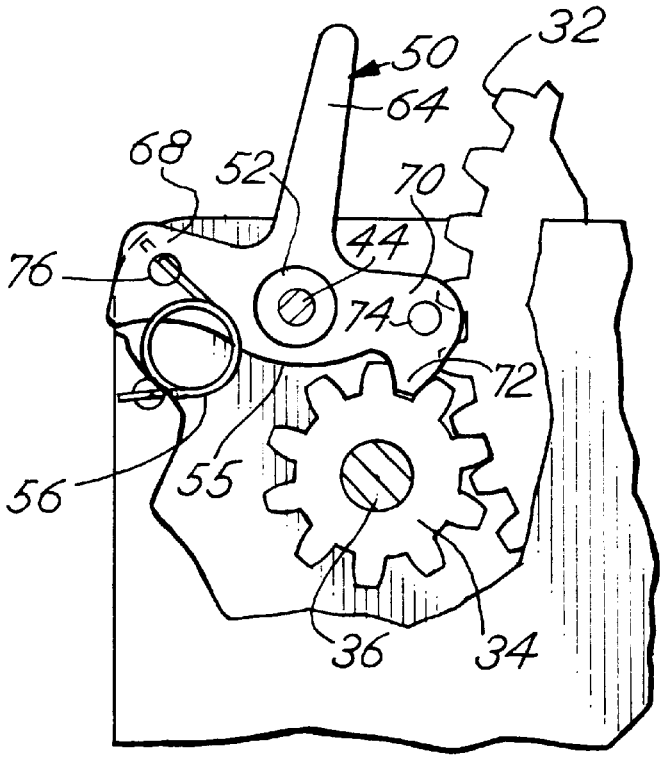
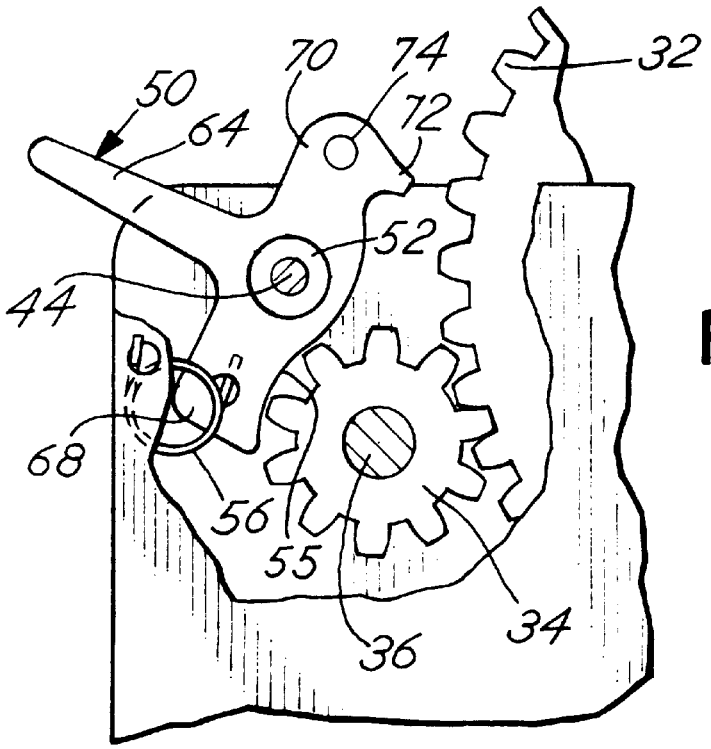
FIG.2D

REVERSIBLE WINCH RATCHET MECHANISM

BACKGROUND OF THE INVENTION

This invention relates to a mechanical winch, and more particularly, to a mechanical winch which includes a mechanism for locking the winch reel to permit rotation only in either a clockwise or counterclockwise rotational mode and for free wheeling release of the winch from either mode.

Typically, a winch includes a reel about which a cable or strap is wrapped. The reel is usually mounted in a bracket and a spur gear is incorporated in one of the flanges of the reel. The spur gear is driven either directly or through a gear train by other spur gears to provide for a mechanical advantage upon rotation of a drive handle shaft. Mechanical winches operable by manual or motor rotation of the drive shaft handle have been utilized for many decades for the purpose of pulling and winding a strap or cable onto the reel thereby lifting and moving various loads.

Typically, a locking pawl is provided to restrict rotation of the gear train or gears in one direction, either clockwise or counterclockwise. Thus, upon rotating the winch in a desired direction in order to take up cable, for example, against a load, the pawl acts to maintain the reel in position and to preclude release of the cable or strap, as the case may be.

It is a desirable feature of a mechanical winch of this type to be able to choose to take up strap or cable by turning the crank handle (and thus the reel) clockwise or alternately counterclockwise depending on the particular use of the winch. It is also desirable to be able to release strap or cable by free wheeling the winch drum or reel.

These capabilities have, to date, been accomplished by a winch construction wherein a locking pawl can be positioned to preclude either clockwise or counterclockwise movement or positioned at a third or neutral position where the locking pawl does not engage the gear train or gears, and the reel then becomes free wheeling. However, once the choice is made which direction the crank handle (or reel) will be turned to take up strap or cable, one of the two locking positions of the pawl becomes useless and serves only to create unnecessary operator confusion, and the potential for accidental engagement and/or unnecessary noise during fee wheeling.

Thus, there has remained the need to develop a reversible pawl construction which is simplified by having only two positions (locked and free wheeling) which can be easily reversed to allow for locking when cranking the handle clockwise or alternately to allow for locking when cranking the handle counterclockwise. It is further desirable to have a winch with fewer parts and simplified construction.

SUMMARY OF THE INVENTION

In a principal aspect, the present invention comprises a mechanical winch of the type including a reel or drum mounted on a rotation shaft journaled in a bracket wherein the drum is driven by a spur gear directly or through a gear train and further wherein a ratchet lever with a locking pawl lever is pivotally mounted on a separate shaft attached to the bracket. The ratchet lever includes the projecting pawl that engages a spur gear in a manner which precludes rotation of the reel or drum in either the clockwise or counterclockwise direction. The ratchet lever has a generally T-shape and is reversibly mounted on its rotation shaft whereby the lever may be removed and reversed in orientation in order to be placed in a configuration which will limit reel rotation in either one direction or the other. The lever is engaged and biased by an over center acting spring which maintains the pawl in communication or contact with the spur gear to limit the rotational direction of the reel or drum or, alternatively, releases the pawl and maintains the pawl in a released position with respect to the spur gear to thereby permit free reeling operation of the drum or reel.

Thus, it is an object of the invention to provide an improved mechanical winch including a simplified ratchet mechanism that has only two operating positions, locked and free wheeling, which can be quickly and easily reversed to allow for locking when reeling in strap or cable onto the drum or reel upon rotation thereof in either direction.

Yet another object of the invention is to provide a mechanical winch including a ratchet lever that permits free wheeling of the drum or reel in one of its two operating positions and which includes fewer mechanical parts than prior art constructions.

Yet another object of the invention is to provide a rugged, mechanically sound, economical to manufacture, and easy to repair and use mechanical winch construction which is reversible.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 2C is an enlarged partial side plan view depicting the ratchet lever of FIG. 2 in a reversed position relative to the position of FIG. 2A to thereby lock the associated spur gear in a manner which precludes counter clockwise rotation of the spur gear;

FIG. 2D is an enlarged partial side plan view depicting the ratchet lever of FIG. 2C in a free wheeling position;

DESCRIPTION OF THE PREFERRED EMBODIMENT

Figure 1:
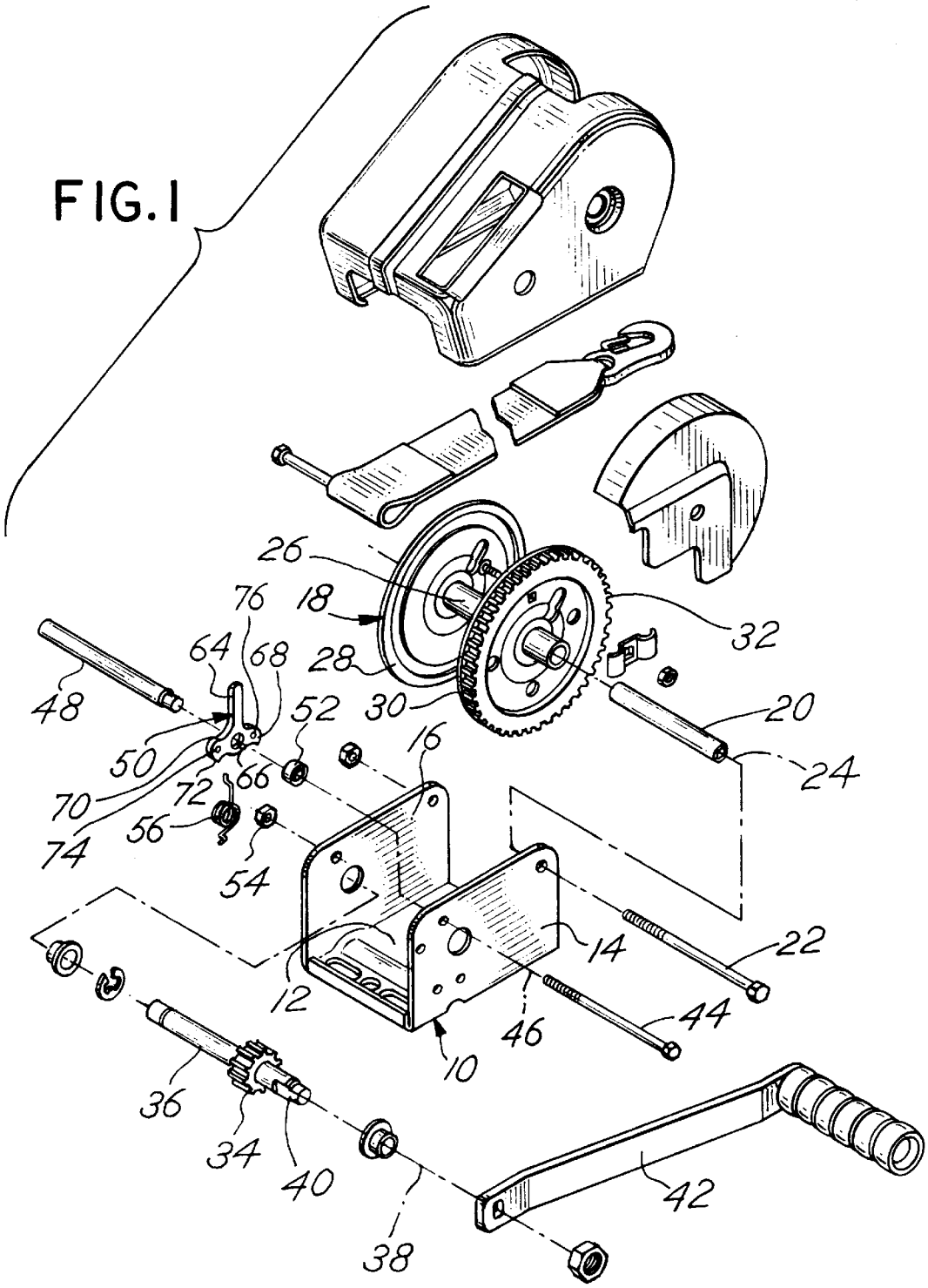
FIG. 1 is an exploded isometric view of the component parts of the mechanical winch of the invention.

Referring to the figures, the winch of the present invention is comprised of a bracket 10 which includes a bottom plate 12 for mounting the bracket on a surface and upstanding side plates 14 and 16 which are parallel to one another and spaced one from the other. A cable or strap drum or reel 18 is mounted on a sleeve 20 which is retained in the bracket by a bolt or shaft 22 and nut 23 so that the drum 18 or reel 18 may rotate about axis 24. The reel or drum 18 includes a center spindle 26 and spaced flanges 28 and 30 with a spur gear 32 mounted on the outside of one flange 30. A strap 31 or cable (not shown) is attached to reel 18 and wound thereon as the reel 18 is rotated.

A second spur gear 34 is mounted on a shaft 36 which is journaled into the side brackets 14 and 16 with bushings 17, 19 for rotation about an axis 38. The end of the shaft 36 includes a keyed fitting or flats 40 adapted to receive a keyed handle 42 retained by a nut 44. The spur gear 34 has fewer teeth and a lesser diameter than the spur gear 32 and meshes with the spur gear 32 so that upon rotation of the handle 42 in either clockwise or counterclockwise direction, the reel 18 is driven in a corresponding sense and a mechanical advantage is obtained.

Attached about a shaft 45 which is fitted into the brackets 14 and 16 along axis 46 is a sleeve 48 positioned between the brackets 14 and 16. Positioned on this sleeve 48 on a reduced diameter area 49 is a ratchet lever 50 and a spacer washer 52. A nut 54 holds the assembly together. A coil spring 56 connects to the ratchet lever 50 at one end 51 and has its opposite end 53 fitted into the bracket 14. The spring 56 is an over center acting spring which maintains the pivotal ratchet lever 50 in either of two positions. The ratchet lever 50 is a T-shaped member with a central leg 64 which is designed for manual manipulation to rotate the ratchet lever 50 from one position to the other about the mounting axis 46 which passes through an opening 66 through the lever 50. A first leg 68 projects outwardly from the central leg 64 in one direction and a second leg 70 projects in the opposite direction. A pawl 72 is defined at the end of the second leg 70. Coil spring openings 74 and 76 are defined in the legs 70 and 68, respectively, for receipt of one end (51 or 53) of the coil spring 56.

The lever 50 is thus mounted on the reduced diameter area 49 of sleeve 48 which passes through the opening 66. The lever 50 may be mounted with the pawl 72 extending in either direction. In each of the two possible mounting orientations of the lever 50 there are two possible operating positions of the lever 50. The two operating positions can be described as "engaged" when the leg 64 of lever 50 is manually rotated to engage pawl 72 into the gear teeth 34, and "disengaged" when the leg 64 of lever 50 is manually rotated so that pawl 72 does not engage the gear teeth 34.

Figure 2:
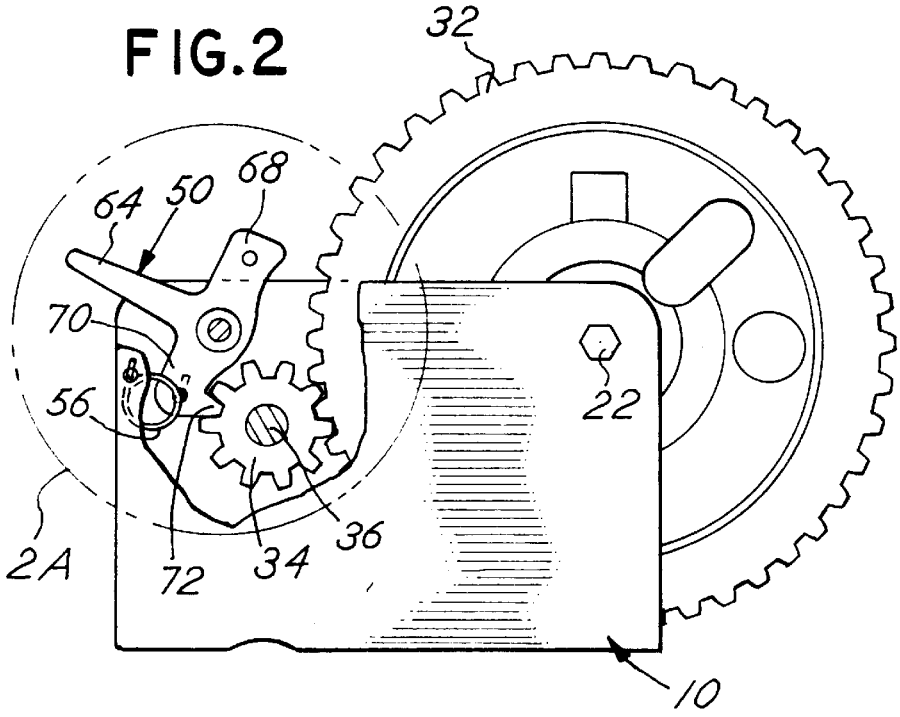
FIG. 2 is an enlarged side plan view of the ratchet lever incorporated in the winch of FIG. 1 in combination with an over center acting spring utilized in combination with the ratchet lever.
Figure 2A:
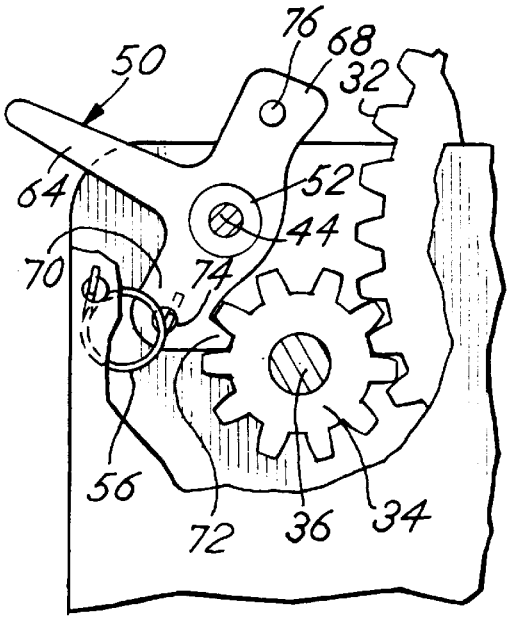
FIG. 2A is an enlarged partial side plan view of the ratchet lever of FIG. 2 with the lever positioned to lock the associated spur gear in a manner which precludes clockwise rotation of the spur gear.
Figure 2B:
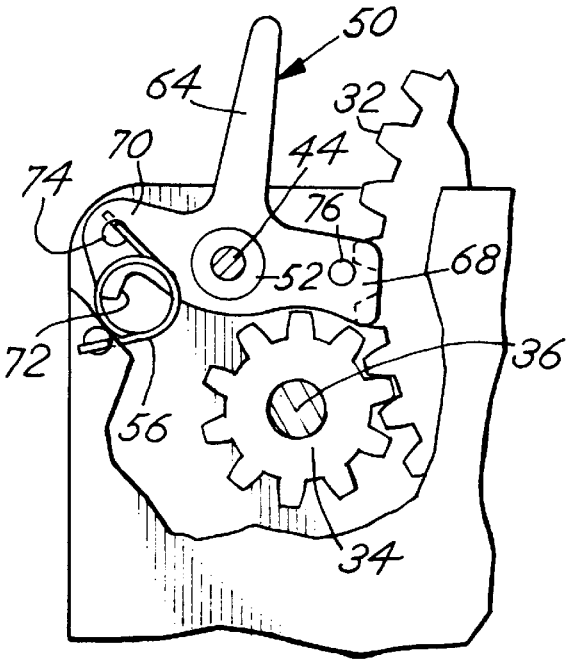
FIG. 2B is an enlarged partial side plan view of the ratchet lever of FIG. 2A rotated to the free wheeling position.
Figure 3:
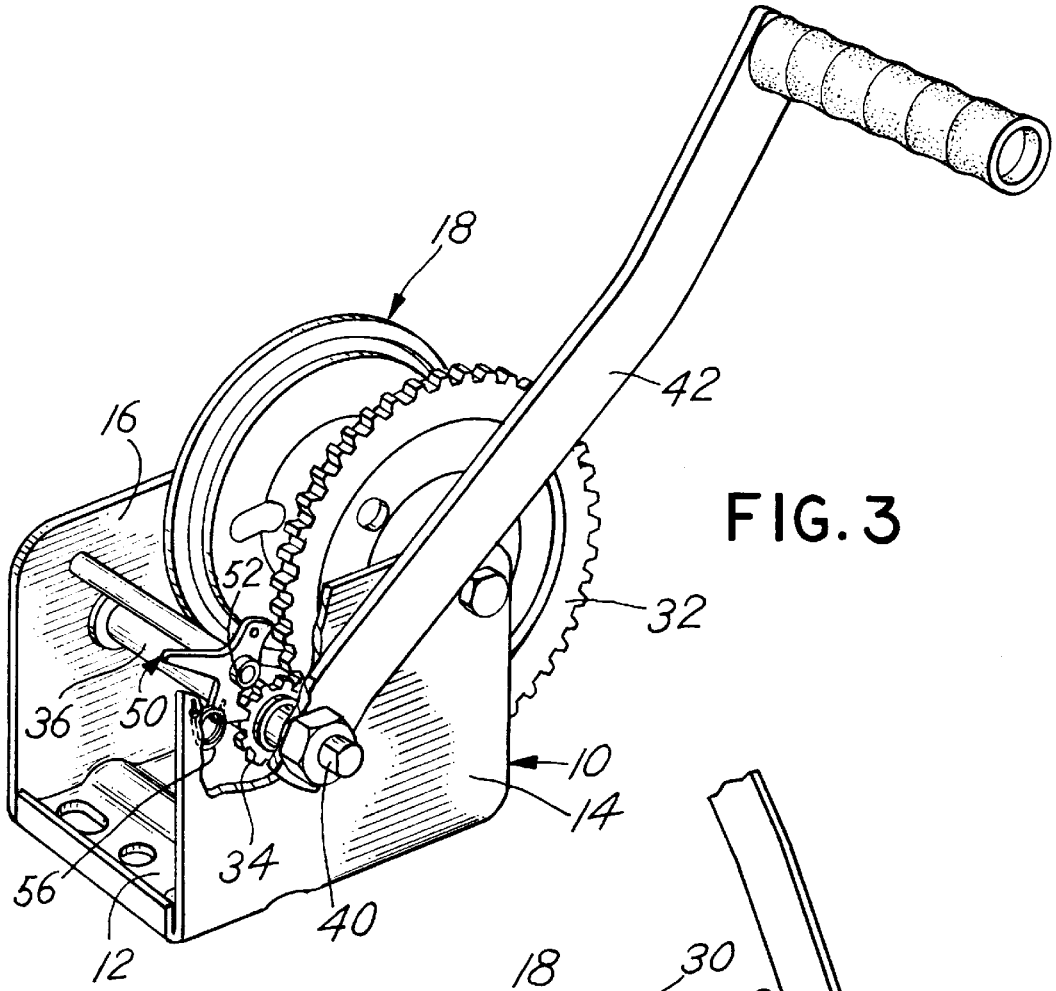
FIG. 3 is an enlarged isometric view depicting the assembly of the ratchet lever, over center acting spring and shaft for mounting the ratchet lever on the bracket.
Figure 4:
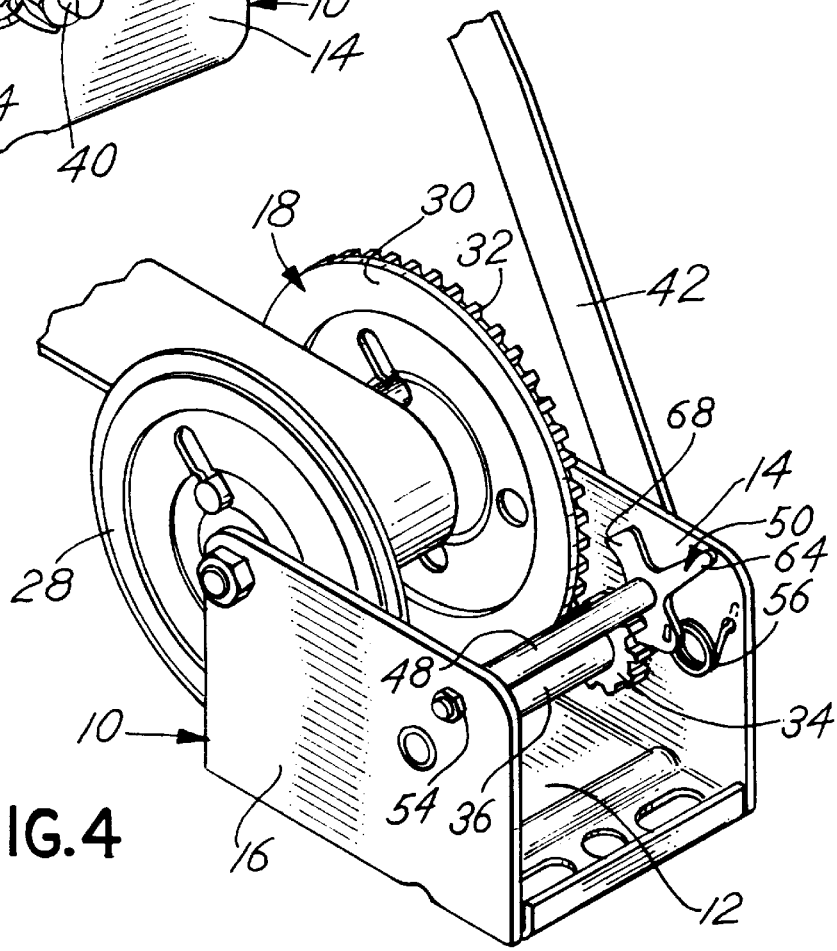
FIG. 4 is an isometric view of the assembled mechanical winch of the invention with a strap mounted on the reel or drum illustrating the manner of operation of the ratchet lever.

When the lever 50 is mounted with the pawl 72 extending in the down direction (FIG. 2A), the "engaged" position of pawl 72 allows counterclockwise rotation of the handle 42 (shaft 36) while clockwise rotation is precluded. The "disengaged" position permits free wheeling rotation of the handle 42 in either direction, and thereby free reeling of the reel or drum 18 in either direction.

When the lever 50 is mounted with the pawl 72 extending in the upward direction (FIG. 2C), the "engaged" position allows clockwise rotation of the handle 42 (shaft 36) while counterclockwise rotation is precluded. The "disengaged" position permits rotation of the handle 42 in either direction, and thereby free reeling of the reel or drum 18 in either direction. The spring 56 fits in one or the other of the openings 74, 76 in order to act as an over center acting spring.

In order to reverse the locking action of the pawl 72, the shaft 44 is withdrawn from the brackets 14 and 16 to allow the removal of sleeve 48 and lever 50. The ratchet lever 50 is then physically reversed on sleeve 48 whereupon sleeve 48 (reduced section 49) is replaced and pin 45 is again reinserted through the assembly and the coil spring 56 is inserted in the appropriate opening 74 or 76 of lever 50 and the bracket 10.

It is noted that the winch may be assembled to preclude either clockwise or counterclockwise rotation of a winch handle and reel 18. The shaft 45 must be removed and the lever 50 reversed in order to change the permitted direction of movement of the reel 18. Lever 50 is directly in contact with a narrow diameter section 49 of sleeve 48 to facilitate desired pivotal motion of lever 50 by manual actuation. Also, the curved underside 55 of lever 50, when lever 50 is in a free wheeling position, rides directly on the edges or tips of spur gear teeth of gear 34. The teeth of gear 34 consequently function to limit pivotal movement of lever 50 while permitting free wheeling thereby eliminating the need for additional mechanical parts to control or limit travel of lever 50. Further, the spring 56 is symmetrical and thus reversible. Spring 56 may be connected between or to lever 50 and bracket wall 14, as a consequence, with either end of the spring 56 making assembly and attachment of lever 50 an easy operation.

Once a winch is set for reel operation in one direction or the other, it is most likely in a very high percentage of the cases that reversing the direction will be unnecessary. The winch may, thus, be set for either clockwise or counterclockwise rotation. It may be altered at any time desired, however, by reversing the lever 50.

It is noted that the assembly provides for interaction of the ratchet lever 50 with a spur gear directly. However, the ratchet 50 may be positioned in association with the chain of gears to provide for appropriate gear reduction and mechanical advantage. Thus, the position of the ratchet lever 50 is not a limiting feature of the invention. As a consequence, other alternative features may be incorporated with the winch of the invention. The subject matter of the invention is, therefore, to be limited only by the following claims and equivalents thereof.

What is claimed is:

1. In a winch including a housing bracket, a drum mounted on a rotation shaft journaled in the bracket, said drum including a drum spur gear;

a drive spur gear on a drive spur gear shaft, said drive spur gear shaft mounted on the bracket, said drive spur gear being positioned for driving the drum spur gear;

said drive spur gear shaft connectable with a drive handle and rotatable in a clockwise or counterclockwise direction by operation of the handle, the improvement comprising:

a removable ratchet lever shaft mounted on the bracket;

a unitary ratchet lever pivotally mounted on said ratchet lever shaft, said ratchet lever including a single projecting pawl for engaging the drive spur gear to preclude rotation in one of the clockwise or counterclockwise direction, said ratchet lever further including a surface for engaging the drive spur gear for free wheeling movement without engagement of the pawl with said drive spur gear;

an over center acting spring connected to the ratchet lever for maintaining the lever in one of two positions including a first position to engage the pawl with the drive spur gear and a second position to disengage the pawl from the drive spur gear with the surface against the drive spur gear for free wheeling movement, whereby, when said pawl is engaged, the drive spur gear is rotatable in a single sense as a result of engagement of the pawl with the drive spur gear, and when disengaged said drive spur gear is freely rotatable in either sense;

said ratchet lever being mounted on the ratchet lever shaft to preclude rotation of the spur gear in either the clockwise or counterclockwise direction depending upon the mounting position of the ratchet lever; said ratchet lever being mountable on the ratchet lever in a first orientation which precludes clockwise rotation of the drive spur gear and in a second orientation which precludes counterclockwise rotation of the drive spur gear.

2. The improvement of claim 1 including a sleeve and a washer on the ratchet lever shaft to position the lever in opposed relation to a drive spur gear and spaced from a side wall of the bracket.

3. The improvement of claim 1 wherein the ratchet lever is a T-shaped member with a central leg for manual manipulation and opposite extending arms from one end of the leg, one of said arms including a depending pawl and each arm includes means for connecting with said spring.

4. The improvement of claim 1 or 3 wherein the spring comprises a coil spring having one end attachable to the bracket and the opposite end attachable to the ratchet lever.

5. The improvement of claim 1 wherein the drive spur gear meshes with the drum spur gear and with the pawl.

6. The improvement of claim 1 wherein the spur gears and ratchet lever have parallel axes.

* * * * *